US005348096A

United States Patent [19]

Williams

[11] Patent Number: 5,348,096

[45] Date of Patent: Sep. 20, 1994

[54] ANISOTROPIC COMPOSITE TUBULAR EMPLACEMENT

[75] Inventor: Jerry G. Williams, Ponca City, Okla.

[73] Assignee: Conoco Inc., Ponca City, Okla.

[21] Appl. No.: 56,267

[22] Filed: Apr. 29, 1993

[51] Int. Cl.[5] ..... E21B 43/112

[52] U.S. Cl. ..... 166/384; 166/242

[58] Field of Search ..... 166/380, 384, 242

[56] References Cited

U.S. PATENT DOCUMENTS 3,704,749 12/1972 Estes et al. ..... 166/255

5,103,912 4/1992 Flink ..... 166/384 X

*Primary Examiner*—William C. Neuder

*Attorney, Agent, or Firm*—John E. Holder

[57] ABSTRACT

An anisotropically tailored tubular (fabricated of a composite having an unsymmetrical bias of the reinforcing components of the composite and an elasticity of the matrix thereof such that at least one of compression stress along the long axis of the tubular or tension stress along the long axis of the tubular or pressure on the interior of the tubular will cause localized twisting and/or extension and/or bending of the tubular along its long axis) is run into a depth extended aperture while imparting localized twisting and/or extension and/or bending to the tubular along its length during the course of the running by impressing at least one of compression stress along the long axis of the tubular, or tension stress along the long axis of the tubular, or pressure on the interior of the tubular. Frictional resistance to the running is thus decreased by the localized twisting, bending, and/or extension. Ability to traverse long distances is thus obtained by overcoming the tendency to become stuck by static frictional forces—a "wiggle worm" effect.

16 Claims, 4 Drawing Sheets

ANISOTROPIC COMPOSITE TUBULAR EMPLACEMENT

BACKGROUND OF THE INVENTION

1. Field Of The Invention

The invention relates to emplacement of tubulars in extended reach boreholes and other depth extended apertures such as highly deviated casing strings and horizontal pipelines. In one aspect presently considered to be of premier importance, the invention relates to emplacing an anisotropically tailored tubular into an extended reach borehole.

2. Brief Description of the Prior Art

With continued depletion of hydrocarbon reserves and continued very trying economic conditions in the oil industry, improved methods for production of hydrocarbons, particularly from marginal reservoirs, is of high importance. One technology that has recently come into ever increasing use is the employment of highly deviated or extended reach horizontal boreholes to produce hydrocarbon-containing reservoirs. This is often advantageous in that remote reservoirs can be produced from a central location. Some examples are as follows: an underwater reservoir may in some circumstances be produced from an on land site with considerable economic and environmental advantages. A single platform can be employed to tap radially extended subterranean reservoirs. Certain types of reservoirs such as those found in undulating ancient sand dunes can advantageously be produced by an extended reach borehole.

When highly deviated or extended reach boreholes reach great lengths, for example, measured in several thousands of feet or in miles or kilometers, it becomes very difficult to emplace tubulars such as tubing strings, or tubulars which are employed to run logging tools and the like over considerable deviated or horizontal distances in order to reach the extent of the producing reservoirs tapped by the boreholes. Presently, extended reach boreholes have been drilled over 1000 meters in a lateral direction. The method of this application may make much greater distances feasible.

Emplacing the tubular must overcome the frictional forces of the horizontal or highly deviated borehole, and over extended distances, this becomes very difficult because of frictional forces of the walls of the borehole on the outer surface of the tubulars. The problem eventually becomes analogous to trying to push a rope up hill, and for any particular system, a limit of how far the tubular can be pushed into the depth extended aperture is reached. The same type of problem occurs with emplacing tubulars in horizontal pipelines and the like. For example, it is often desired to emplace a tubular into a horizontal pipeline in order to dissolve paraffin or other materials which are restricting flow in the pipeline.

Recently, there has also been much interest in the use of composite tubulars in oil industry applications, for example, as tubing strings or as employed to emplace logging tools and the like, particularly in highly deviated or extended reach boreholes. This is particularly attractive because such tubulars can often be fabricated in great lengths. Such coiled tubing strings, as they are commonly known, are simply unreeled as they are extended into extended reach boreholes and the like by means of capstan wheel arrangements, grip-and-push mechanisms, or tracked tubing injectors. The prior art contains numerous disclosures of this technology.

One basic reference on such composite materials is the "Primer On Composite Materials: Analysis" Volume III, Progress and Materials Science Series, Technomatic Publishing Company, Inc., 750 Sumner Street, Stanford, CN 06901 (1969). This reference discusses the general theory of anisotropically tailored materials including tubulars fabricated of helically wound composites which will provide rotation upon application of tension or compression along the long axis of the tubular. Conversely, application of torsion to the tubular shows an increase or decrease in the length of the tubular. The reference otherwise provides a generalized disclosure of fabrication of and characterization of anisotropically tailored composites.

The invention of this application utilizes these characteristics to provide a method for emplacing tubulars in depth extended apertures, thus providing a solution for the problem faced by the art, as set out above.

OBJECTS OF THE INVENTION

An object of the invention is to provide a method for emplacing tubulars in depth extended apertures, such as extended reach or highly deviated boreholes, or generally horizontal pipelines. The "wiggle worm" method disclosed and claimed herein, enables emplacement of tubulars with much greater extension and horizontal outreach than has been possible to date.

SUMMARY OF THE INVENTION

An anisotropically tailored tubular (which is fabricated of a composite having an unsymmetrical bias of the reinforcing components of the composite and an elasticity of the matrix thereof such that at least one of compression stress along the long axis of the tubular or tension stress along the long axis of the tubular or pressure on the interior of the tubular will cause localized twisting and/or bending and/or extension of the tubular along its long axis) is extended into a depth extended aperture such as a highly deviated or extended reach borehole or generally horizontal pipeline. This is done by running the tubular into the depth extended aperture, for example, off of a reel by means of capstan wheels, a grab-and-push mechanism or a tracked tubing injector while impressing at least one of (a) compression stress along the long axis of the tubular or (b) tension stress along the long axis of the tubular or (c) pressure on the interior of the tubular during the course of the running such that localized twisting and/or bending and/or extension is imparted to the tubular along its length during the course of the running. Frictional resistance to the running is decreased because of the localized twisting and/or bending and/or extension action and because friction along the entire length of the tubular does not need to be overcome at one time because of the localized twisting and/or bending and/or extension action. In effect, the tubular is extended into the depth extended aperture with a "wiggle worm" action. Presently, the "wiggle worm" effect is preferred to be imparted by repeated pressuring and depressuring of the anisotropically tailored tubular.

PREFERRED EMBODIMENTS OF THE INVENTION

In accordance with one presently preferred embodiment, the anisotropic tubular is fabricated by winding, braiding or laminating a high strength reinforcing component such as a filament or fiber of an aramid polymer, carbon, glass, or high strength metal such as drawn steel onto a strong tubular having some elasticity, in a matrix such as a high strength thermosetting resin such as an epoxy system, a vinyl system, a polyester system, a phenolic resin, or a thermoplastic such as high density polyethylene, polypropylene, polyetheretherketone, polyarylamide, polyamide, polyetherketoneketone, or any number of other engineering plastics. The inner tubular can be nylon, high density polyethylene, polypropylene, or other high strength plastics, or metals. It is important that the inner tubular and the resin matrix and the reinforcing components have good adhesion. It is also important that the matrix be reasonably stiff, but yet have sufficient elasticity and high strain capability such that localized twisting and/or bending and/or extension will be effected upon application of longitudinal tension or compression or upon pressurization of the interior of the tubular.

The anisotropic nature of the tubular can be imparted by winding, braiding or laminating the reinforcing component on the bias such that the angle of winding in one direction is different from the angle of winding in the other direction, or similar bias can be imparted in the braid. The anisotropic nature can also be imparted by winding in one direction with a composite having greater fiber or filament tensile strength, greater diameter of the fibers or filaments, or more of the fibers or filaments than is wound in the other direction. The stackina sequence of layers in the composite can also impose anisotropy.

According to one presently preferred embodiment, anisotropic properties are imparted by winding or braiding the reinforcing component onto a tubular in a thermoplastic or thermosetting matrix, and then imparting a twist to the tubular prior to setting up of the matrix. The tubular can also be braided with reinforcing components in a matrix, and then a twist can be imparted to the tubular prior to complete curing of the matrix.

According to one specific presently preferred embodiment, KEVLAR aramid cordage which is impregnated with an epoxy resin and a curing agent is braided onto a nylon tubular. Longitudinal twist is imparted prior to gelling and curing. Upon curing by application of heat, an anisotropically tailored tubular results which exhibits bending/twisting/extensional coupling.

Other methods of fabricating an anisotropic tubular meeting the criteria set forth above may also suggest themselves to those skilled in the art, or a suitable anisotropic tubular can be fabricated by experimentation not amounting to the invention by those skilled in the art, all within the scope of this application. All that is necessary is that the tubular provide localized twisting and/or bending and/or extension upon application of at least one of longitudinal tension or compression or pressuring. Of course, the tubular must otherwise have sufficient strength, stiffness, flexibility, resistance to chemical degradation, resistance to heat, etc. for the particular application. For example high strength metal bands can be spirally wound on and adhered to a plastic tubular.

In accordance with one presently preferred embodiment, an anisotropic tubular is run into a depth extended aperture while repeatedly pressurizing and depressurizing the tubular such that localized twisting runs up and down the length of the tubular during the course of the running.

FIGS. *2a* and *2b* illustrate the localized twisting which is impressed upon a section of an anisotropic tubular of the invention upon application of internal pressure.

FIG. *2a* illustrates the tubular before application of pressure and FIG. *2b* illustrates the localized twisted tubular after application of internal pressure.

Figure 3:
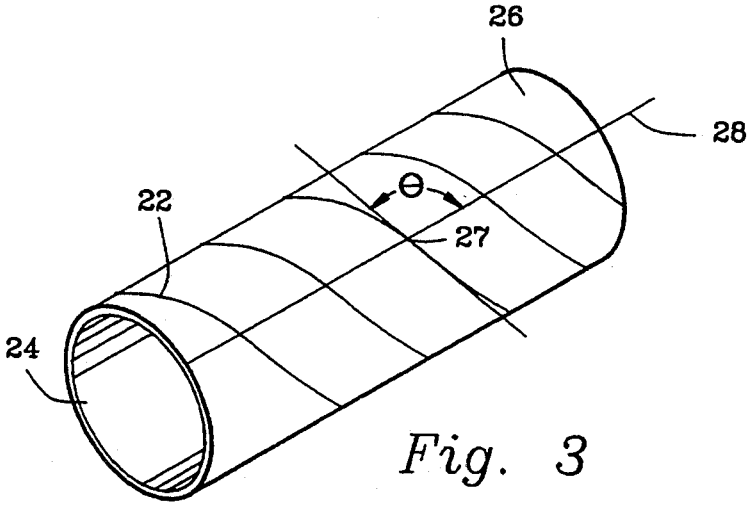

FIG. 3 illustrates the angle $\theta$ which is the variable angle of application of a lamina or material measured as the tangent to the material as it lays on the tubular.

Figure 4:
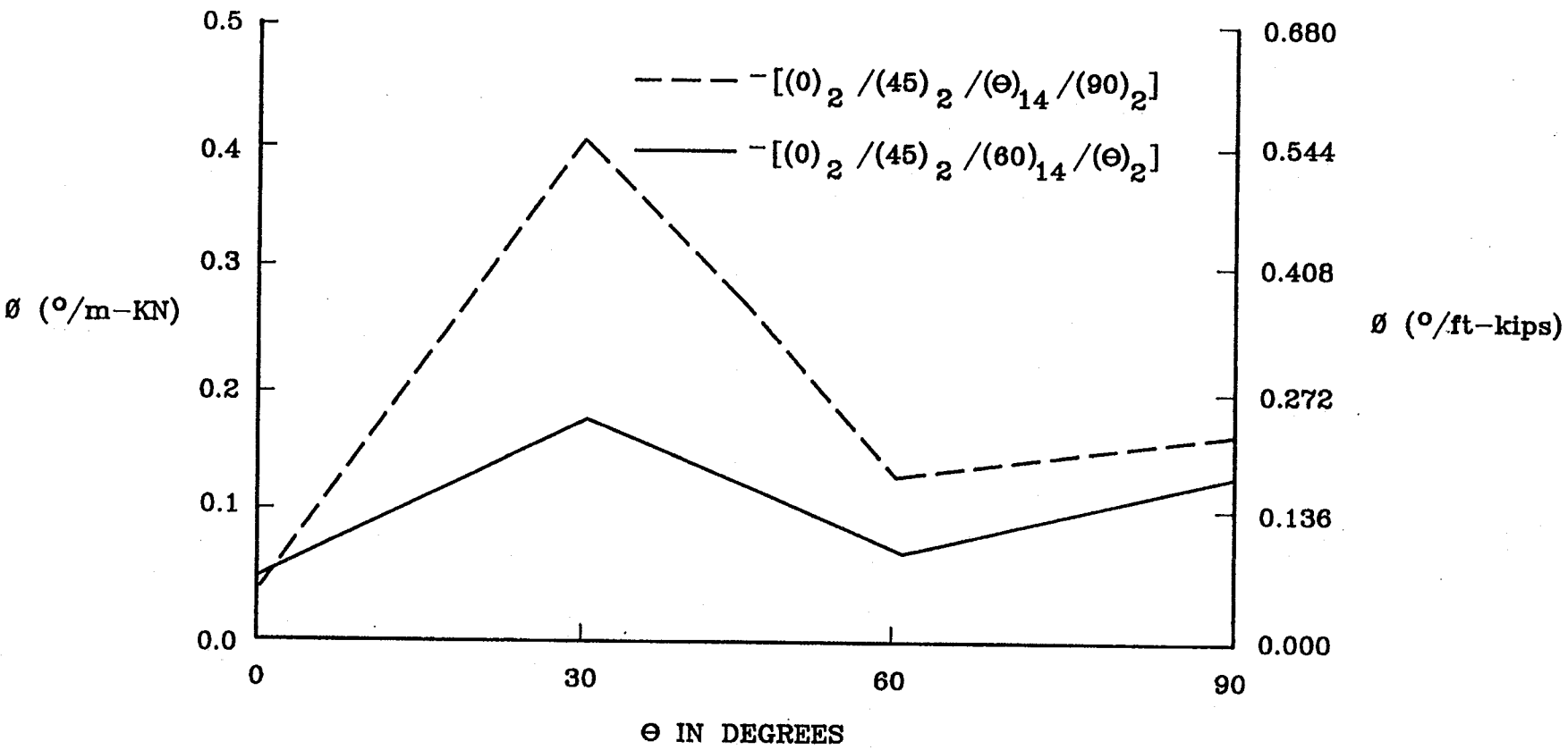

FIG. 4 shows a graphic presentation depicting the twist angle of a tubular member per unit of axial force applied to a tubular.

Figure 5:
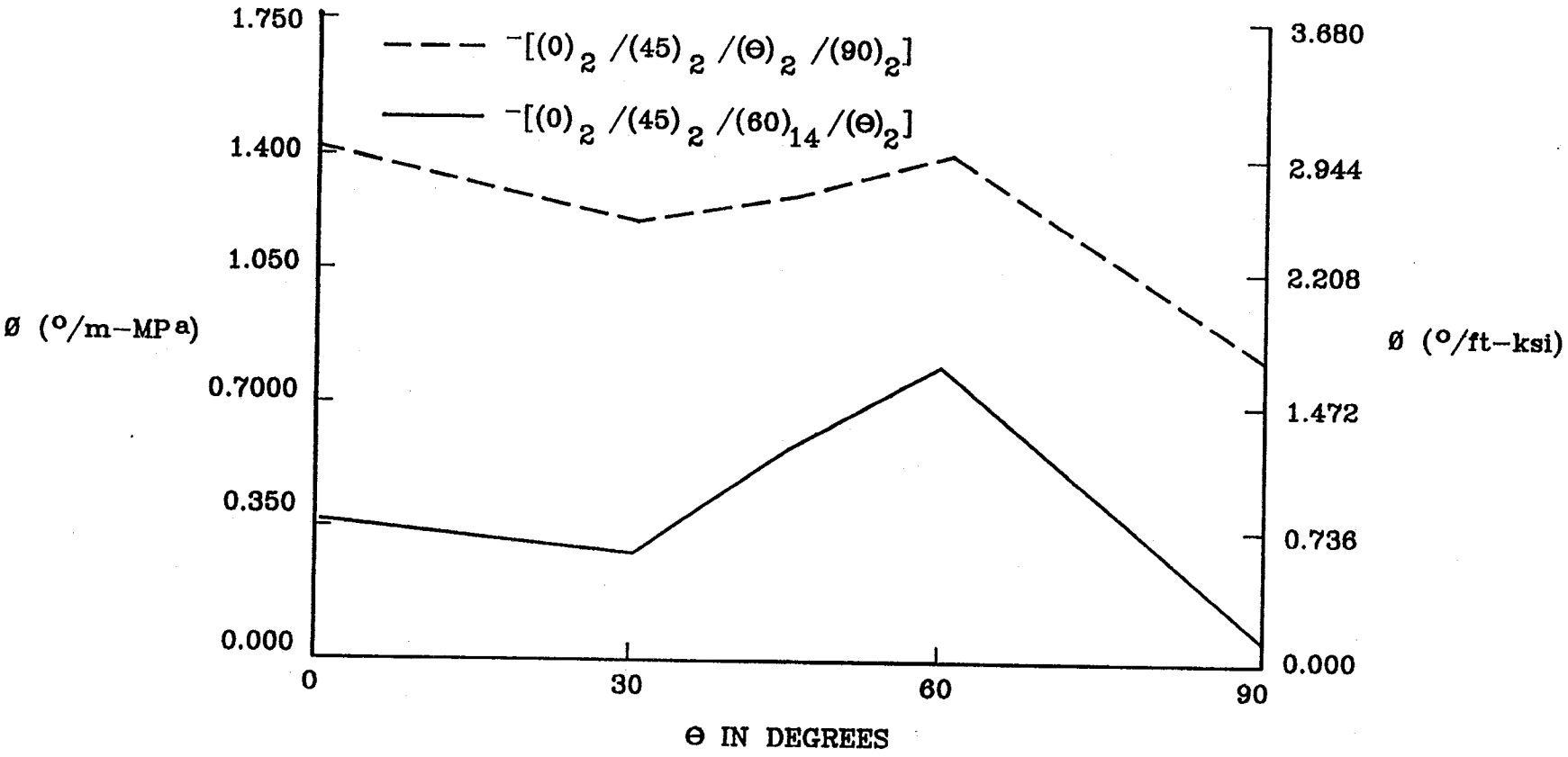

FIG. 5 shows a graphic presentation of the twist angle of a tubular member per unit of applied internal pressure for a composite tubular of different constructions.

DESCRIPTION OF THE DRAWINGS

The drawings and the description thereof, as well as the exemplification and description relating to preferred modes are provided to more fully explain the invention and to provide information to those skilled in the art on how to carry it out. However, it is to be understood that such is not to function as a limitation on the invention as described and claimed in the entirety of this application.

Figure 1:
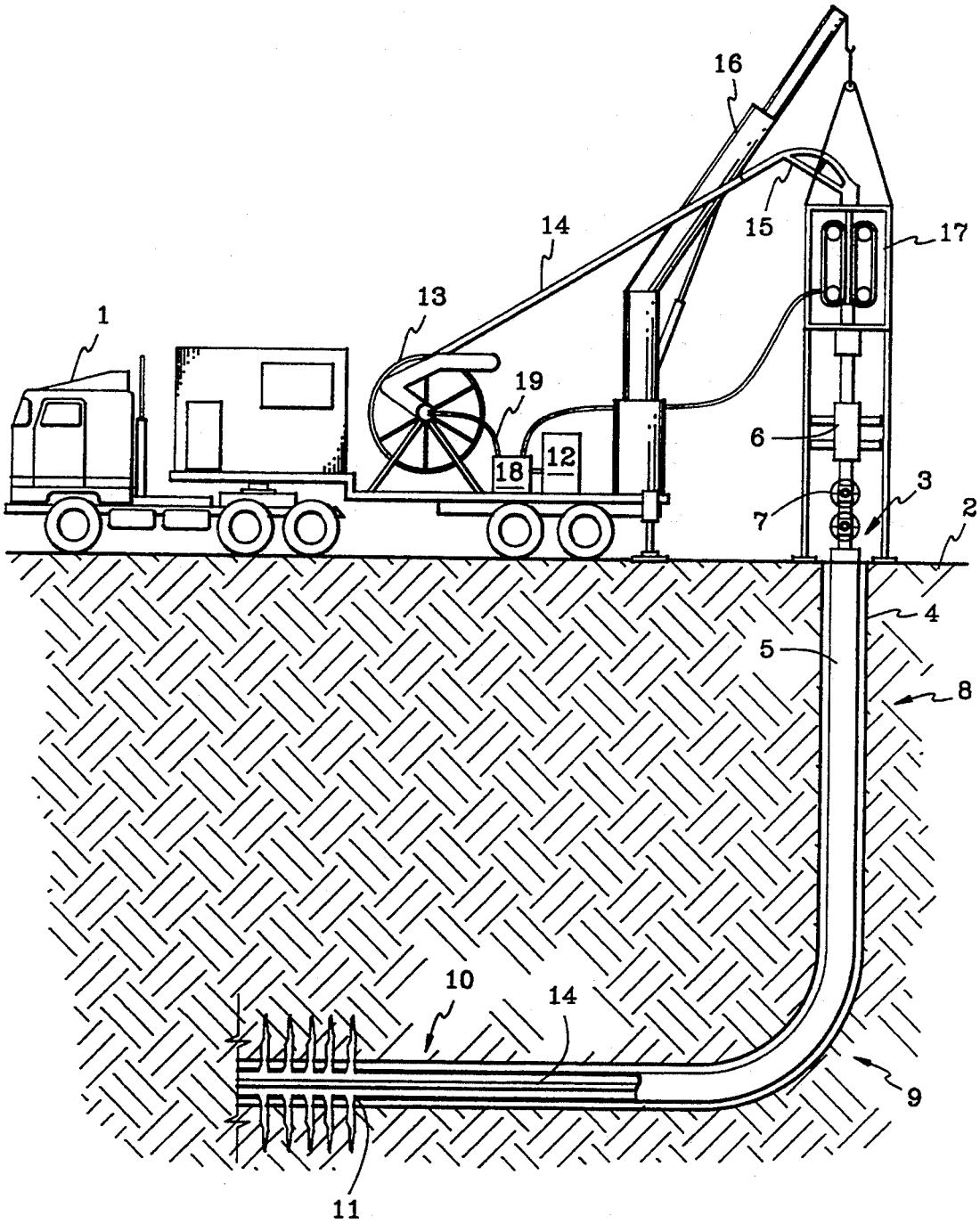
FIG. 1 illustrates in semi-schematic fashion the apparatus and method of emplacing an anisotropically tailored tubular of the invention into a highly deviated and horizontal borehole.

Thus, referring to FIG. 1, truck 1 is positioned on the earth's surface 2 near the wellhead 3 of borehole 4 having casing 5 which penetrates into the earth. The wellhead has blowout preventers 6 and valving assembly 7. It extends into the earth for a first vertical section 8, a deviating section 9 and a horizontal section 10 as shown. The well casing 5 has perforations 11 in a lateral section at a locus greatly horizontally deviated from the wellhead 3.

Truck 1 has power pack 12, hydraulically operated coiled tubing reel 13, crane 16 which supports tubing guide 15 and hydraulic drive tubing injector 17 for inserting an anisotropic tubular 14 through tubing guide 15 and into borehole 4 as shown.

A control console 18 controls supply of hydraulic fluid through lines 19 from power pack 12 to reel 13 and to hydraulic drive tubing injector 17 such as to unreel the anisotropic tubing 14 into the wellbore. Control console 18 also controls supply of hydraulic fluid to the end of the anisotropic tubular which is on the interior of the reel such as to alternately pressure and depressure the anisotropically tailored tubular along its length and such as to impart localized twisting, extension, and bending along the long axis of the tubular while the tubular is being inserted into the wellbore. The anisotropic effects may also be introduced by the application of axial compression or tension loads to the tubular. Twisting the tubular can also produce these effects such as by changing the axial length or bending. Changes in temperature of the fluid supplied into the tubular may also be used to impart localized twisting, extension, bending, etc. to the anisotropic tubular. Thus, the application of a variety of forces can be used to accomplish the desired anisotropic coupling effects.

Figure 2A:
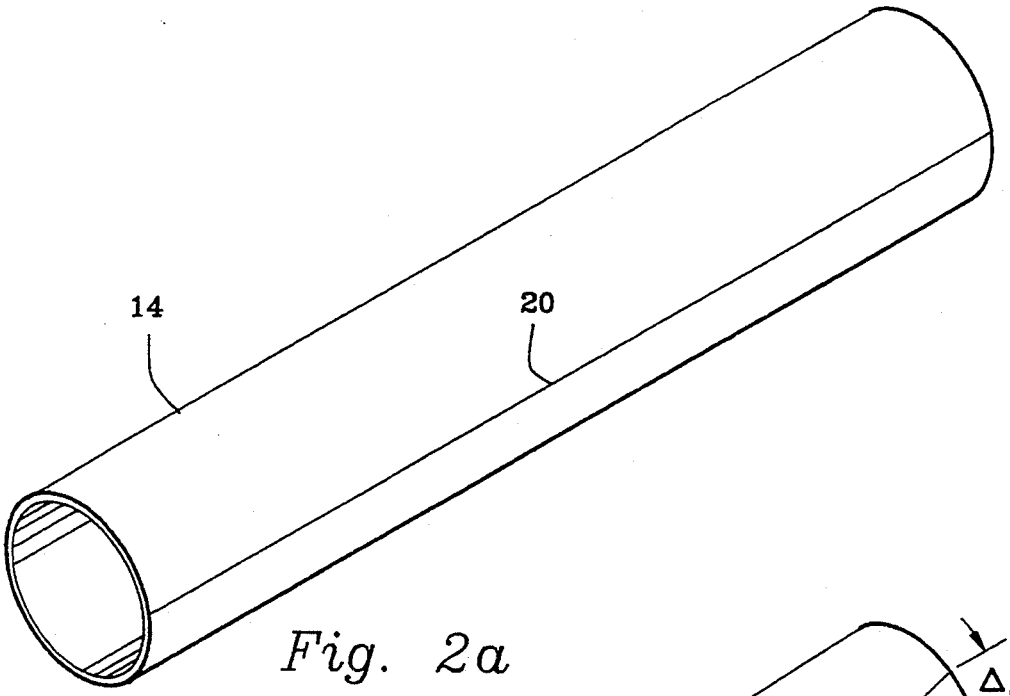
Figure 2B:
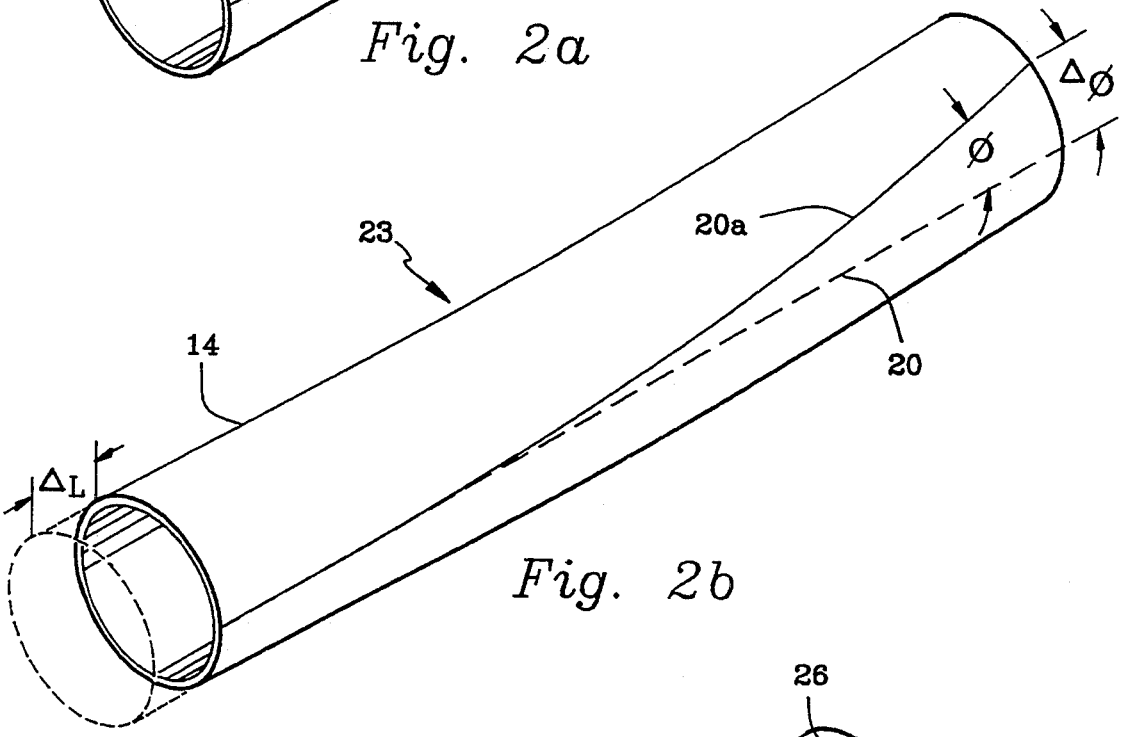

As shown in FIGS. *2a* and *2b*, a section of the tubular 14 shows a line 20 inscribed longitudinally along its long axis on the surface of the tubular for purposes of illustration. Upon application of forces to the section of anisotropic tubular as shown in FIG. 2*b*, the line 20 (dotted) assumes a spiral configuration due to localized twisting of the anisotropic tubular. Rotational displacement $\Delta\theta$ of the line 20 to a position 20*a* represent the twist per unit length of this line. $\phi$ is the angle of twist. Upon application of forces in the section of anisotropically tailored tubular, the tubing may also assume a localized bend 23 along its long axis as shown in FIG. 2*b* and in addition, the tubular 14 may shorten or lengthen as shown by the incremental length $\Delta_L$.

Referring to FIG. 3, an anisotropically tailored tubular is partially illustrated as having a high strength reinforcing component 22 such as a filament or fiber, wound or braided as a lamina onto a strong tubular sheath 24 having some elasticity, in a matrix 26 such as a high strength thermosetting resin applied to the tubular 24. The fibers 22 in the lamina are shown applied to the tubular at an angle $\theta$ which is the angle between a tangent to the fibers 22 at an arbitrary point 27 and a longitudinal line 28 which is in the plane of the lamina passing through the arbitrary point 27 and parallel to the longitudinal axis of the tube.

In the theory of composite materials, the stress resultants and moments are related to the strains and curvatures by the matrix algebra relationship set forth below in equation (1) or (2):

$$\begin{bmatrix} N_1 \\ N_2 \\ N_6 \\ M_1 \\ M_2 \\ M_6 \end{bmatrix} = \begin{bmatrix} A_{11} & A_{12} & A_{16} & B_{11} & B_{12} & B_{16} \\ A_{12} & A_{22} & A_{26} & B_{12} & B_{22} & B_{26} \\ A_{16} & A_{26} & A_{66} & B_{16} & B_{26} & B_{66} \\ B_{11} & B_{12} & B_{16} & D_{11} & D_{12} & D_{16} \\ B_{12} & B_{22} & B_{26} & D_{12} & D_{22} & D_{26} \\ B_{16} & B_{26} & B_{66} & D_{16} & D_{26} & D_{66} \end{bmatrix} \begin{bmatrix} \epsilon_1 \\ \epsilon_2 \\ \epsilon_6 \\ \kappa_1 \\ \kappa_2 \\ \kappa_6 \end{bmatrix} \quad (1)$$

OR $$\begin{bmatrix} N_i \\ M_i \end{bmatrix} = \begin{bmatrix} A_{ij} & B_{ij} \\ B_{ij} & D_{ij} \end{bmatrix} \begin{bmatrix} \epsilon_J \\ \kappa_j \end{bmatrix} \quad (2)$$

where: $N_i$ are the stress resultants, $M_i$ are the bending moments $\epsilon_i$ are the strains, and $K_i$ are the curvatures in the incremental element of the composite. For an anisotropic material there are a total of eighteen unique elastic coefficients describing the bending-stretching-twisting coupling as represented by the 18 unique constants in the matrix equation (1) above. For an isotropic material such as steel, these elastic coefficients are reduced to only two terms and the mechanical load-deformation characterization is much simpler.

In composite mechanics terminology, a material is midplane symmetric if for every layer (lamina) at a distance $+d_i$ from the midplane of the composite assembly to the center of lamina; and which is oriented at angle +theta there is another lamina at a distance $-d_i$ from the midplane also oriented at angle +theta. If a composite laminate is midplane symmetric, the $B_{ij}$ terms (equation (2)) are null thus eliminating the bending/extensional coupling. It is common practice in many composite designs to make the laminate midplane symmetric for the express purpose of eliminating such complex mechanical behavior.

If for every +theta oriented lamina there is another lamina of the same material and thickness somewhere in the laminate oriented at −theta, we have a unique case sometimes called "specially orthotopic." In this case, the $A_{16}$, $A_{26}$ terms are equal to zero thus eliminating inplane extension/shear coupling.

In another special case, if for every lamina at distance $+d_i$ oriented at angle $\theta$ there is the same lamina at distant $-d_i$ from the midplane oriented at angle $-\theta$, then the $D_{16}$ and $D_{26}$ terms are zero thus eliminating bending/twisting coupling. This laminate, however, is not mid-plane symmetric, therefore, the $B_{ij}$ are not zero.

In aircraft design, special tailoring of material orientation, thickness, and location within the cross-section is sometimes used to intentionally introduce anisotropy with inplane force/moment coupling, extension/shear coupling and bending/twisting coupling. For example, the advanced fighter X29 has an anisotropically tailored composite wing which provides aeroelastic tailoring to make the wing shed load under divergent conditions.

The present invention uses a laminate construction which intentionally introduces anisotropy to achieve complex movement of a tubular through extensional, bending and twisting coupling. Mathematically, this means that the laminate may be described by more than four elastic properties represented by [A], [B]and [C]terms or by as many as eighteen such terms. Such anisotropy is intended to provide extensional, bending and twisting coupling of the composite tubulars for the purpose of providing rotation and translation of the tubular as a consequence of the tubular being loaded axially in compression or tension and/or torsion and/or by internal pressure.

The application for the invention is for composite coiled tubing and logging pipe or other application where one wishes to transport a long tube into a larger size annulus. In a wellbore application, as the composite coiled tubing is driven into the borehole, the friction resistance of the pipe to sliding in the hole will eventually develop sufficient force to buckle the pipe. Further progress in moving the pipe into the hole thus occurs by trying to move the spiral shaped buckled pipe assembly. All of the pipe is not necessarily buckled, but it is the buckled pipe which provides the greatest resistance to translation into the borehole.

The anisotropic properties built into the pipe of the present invention impose rotational and translation motion to the pipe as it is loaded in compression or tension and/or internal pressure. This rotatory and translation motion reverses locally as the pipe slips and slides inside the hole and the magnitude of the local axial load and/or pressure changes. In other words, the rotation and translation of the pipe is in concert with the magnitude of the local axial load and/or pressure. The magnitude of the axial force changes locally as the pipe moves and changes mode shape. Oscillatory rotation (clockwise and counterclockwise) permits sliding friction to govern the friction loads on the pipe rather than static friction. Sliding friction is significantly lower than static friction and this advantage permits greater depths and reach into the wellbore with the anisotropic coiled tubing. In addition, the imposed axial load and pressure imposed at the wellhead can also be varied within a range to further impose oscillatory rotary and axial motion. Pressure pulsation is especially effective since pressure is immediately transferred to all parts of the pipe including the lower reaches of the coiled tubing.

Several design and construction approaches may be used to obtain a composite tubular with the desired anisotropic properties. A theoretical study was performed to demonstrate the load-deformation responses which can be expected for typical anisotropic composite designs. The analysis is formulated on the basis of the well established composite laminate shell theory. Using the analysis, a systematic study was conducted to investigate several of the variables available to tailor anisotropic properties including: the effects of composite fiber orientations, ply stacking sequences, ply thicknesses, and different composite materials systems including hybrids containing combinations of constituent composite materials. Examples of the results are given below.

FIG. 4 presents the twist angle per unit of axial force applied and FIG. 5 presents the twist angle per unit of applied internal pressure for composite tubes constructed of Kevlar ®49/epoxy material and two different anisotropic laminate constructions, i.e., $[(0)_2/(45)_2/(\theta)_{14}/(90)_2]$ and $[(0)_2/(45)_2/(60)_{14}(\theta)_2]$. The variable angle "$\theta$" is plotted as the abscissa and the twist angle "$\phi$" in degrees per unit force or pressure is plotted as the ordinate. This twist can also be seen in comparing FIGS. *2a* and *2b* where "$\Delta_\phi$" defines the rotational displacement of a longitudinal line 20 to 20*a* on the tubular per unit length which makes up the angle "$\phi$". It can be seen that significant anisotropic twisting/axial load or twisting/pressure coupling response is provided by these laminates. Also note that the relative magnitude of twisting/axial load or twisting/pressure is reversed for the two tube designs. These results are merely representative of the vast flexibility that can be exercised in the design of composite tubes to provide the desired anisotropic behavior.

Thermal effects can also generate an anisotropic response in these anisotropically tailored tubular structures. The anisotropic arrangement also introduces thermal mechanical effects (analogous to the interaction of bimetallic materials) which will result in rotary and axial displacements of the tubular in response to changes in temperature. Changes in temperature can be transmitted to the lamina by the introduction of fluids into the tubular sheath 24 at the surface which are at a different temperature than the local temperature of the lamina.

It is therefore seen that anisotropic behavior can result from differences in angular orientation of fibers or materials, differences in distance of such materials from the midplane of a structure or from dissimilar materials making up the lamina.

Therefore, while particular embodiments of the present invention have been shown and described, it is apparent that changes and modifications may be made without departing from this invention in its broader aspects and, therefore, the aim in the appended claims is to cover all such changes and modifications as fall within the true spirit and scope of the invention.

I claim:

1. A method for extending an anisotropically tailored tubular (fabricated of a composite having an unsymmetrical bias of the reinforcing components of the composite and an elasticity of the matrix thereof such that at least one of compression stress along the long axis of the tubular or tension stress along the long axis of the tubular or pressure on the interior of the tubular will cause localized twisting and/or bending and/or extension of the tubular along its long axis) into a depth extended aperture comprising:

(a) running the tubular into the depth extended aperture, and (b) impressing at least one of compression stress along the long axis of the tubular or tension stress along the long axis of the tubular or pressure on the interior of the tubular during the course of the running such that localized twisting, and/or bending and/or extension is imparted to the tubular along its length during the course of the running, thus decreasing frictional resistance to the running.

2. The method of claim 1 wherein the depth extended aperture is a deviated borehole, pressure is impressed on the interior of the tubular, and localized twisting is imparted to the tubular along its length during the course of the running.

3. The method of claim 2 wherein the deviated borehole is a horizontally extended borehole.

4. The method of claim 1 wherein the depth extended aperture comprises the interior of a horizontally extended tubular.

5. The method of claim 4 in which the horizontally extended tubular is a casing string or a pipeline.

6. The method of claim 2 wherein the anisotropically tailored tubular is repeatedly pressured during the course of the running to impart twisting along its length during such pressuring and intervening depressuring between such repeated pressuring.

7. The method of claim 1 wherein a pushing section V of the anisotropically tailored tubular is reciprocated by pushing and pulling during the course of the running.

8. The method of claim i wherein the anisotropically tailored tubular comprises an aramid, carbon, glass, or metal filament or fiber or band as a reinforcing component and comprises a matrix of a high strength organic thermosetting or thermoplastic resin.

9. The method of claim 2 wherein the anisotropically tailored tubular comprises an aramid, carbon, glass, or a metal filament or fiber or band as a reinforcing component and comprising a matrix of a high strength organic thermosetting or thermoplastic resin.

10. The method of claim 1 wherein said compression stress is imparted to the tubular by passing a fluid through the tubular having a temperature which causes localized twisting, bending or extension of the tubular.

11. An anisotropically tailored tubular suitable for running into a depth extended aperture by impressing at least one of compression stress along the long axis of the tubular, or tension stress along the long axis of the tubular, or pressure on the interior of the tubular, during the course of the running such that localized twisting and/or extension and/or bending is imparted to the tubular along its length during the course of the running, thus decreasing frictional resistance to the running, the anisotropic tubular fabricated of a composite having an unsymmetrical bias of the reinforcing components of the composite and an elasticity of the matrix thereof such that at least one of (a) compression stress along the long axis of the tubular or (b) tension stress along the long axis of the tubular or (c) pressure on the interior of the tubular will cause localized twisting and/or extension and/or bending of the tubular along its long axis.

12. The anisotropic tubular of claim 11 in which the reinforcing component of the tubular comprises an aramid, carbon, glass, or metal filament, band, or fiber and the matrix of the composite comprises a high strength organic thermosetting or thermoplastic resin.

13. The anisotropic tubular of claim 11 in which the anisotropic nature is imparted by winding or braiding the reinforcing component onto an inner tubular within a thermosetting resin and then imparting twist to the composite tubular before the thermosetting or thermoplastic resin sets up.

14. A composite coiled tubing system for use in a wellbore to perform wellbore operations, comprising;

a strong tubular structure having sufficient elasticity for spooling said tubing about a reel at the surface of the wellbore;

reinforcing components arranged about said tubular structure and including fibers bound together in a matrix to form individual lamina;

said lamina being arranged about said tubular structure to form a composite tubing that has an unsymmetrical bias of the reinforcing components such that the tubular structure exhibits anisotropic properties when subjected to changes in thermal mechanical or hydraulic effects applied to said composite tubing to cause rotary or axial motion of said composite tubing.

15. The composite coiled tubing system of claim 14 wherein means are provided for changing the pressure within said composite tubing and thereby cause localized twisting, bending or extension of the composite tubing within the wellbore.

16. The composite coiled tubing system of claim 14 and further including means for introducing a temperature change to the composite tubing at a downhole position in the wellbore to cause localized twisting, bending or axial extension of the composite tubing within the wellbore.

* * * * *